US005180032A

United States Patent [19]

Hidalgo

[11] Patent Number: 5,180,032

[45] Date of Patent: Jan. 19, 1993

[54] LADDER STABILIZER APPARATUS

[76] Inventor: Martiniano A. Hidalgo, 404 First Ave., Elizabeth, N.J. 07206

[21] Appl. No.: 848,073

[22] Filed: Mar. 9, 1992

[51] Int. Cl.[5] ..... E06C 7/48

[52] U.S. Cl. ..... 182/214; 182/107; 182/229; 182/111

[58] Field of Search ..... 182/214, 229, 107, 111; 248/238

[56] References Cited

U.S. PATENT DOCUMENTS

| | | | |
|---|---|---|---|
| 2,419,065 | 4/1947 | Fowler | 182/107 X |
| 2,722,360 | 11/1955 | Malm | 182/214 |
| 3,708,080 | 1/1973 | Schlei | 182/214 |
| 4,331,217 | 5/1982 | Stecklow | 182/214 |
| 4,723,632 | 2/1988 | Gedgoudas | 182/214 |
| 4,754,842 | 7/1988 | Southern | 182/214 X |

*Primary Examiner*—Alvin C. Chin-Shue

*Attorney, Agent, or Firm*—Leon Gilden

[57] ABSTRACT

An apparatus for securing and stabilizing a ladder and extension ladder structure relative to a dwelling is provided, wherein the apparatus initially includes a plurality of arcuate arms mounted adjustably relative to tracks, wherein each track is secured to opposed ladder legs of an associated ladder structure. The arms each include anchor blocks, and the arms forward distal ends are mounted within cavities of each respective anchor block for positioning each anchor block upon a roof top surface. A further aspect of the invention includes organization for positioning and mounting the anchor structure relative to a bottom surface of a roof or to a vertical wall surface to include legs mounted adjustably relative to each ladder leg, wherein each of the legs are formed in an extensible configuration to include anchor structure mounted to each forward distal end of each of the legs.

3 Claims, 4 Drawing Sheets

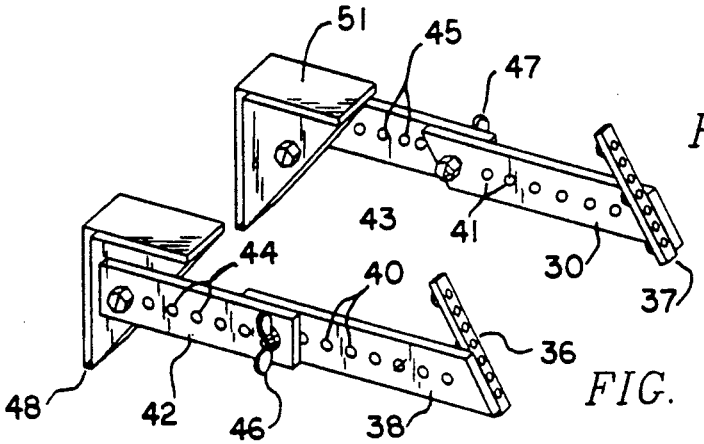
FIG. 11
FIG. 12
FIG. 13
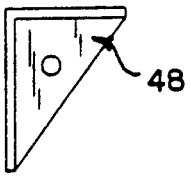
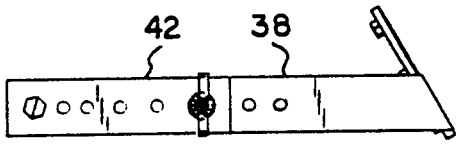
FIG. 14
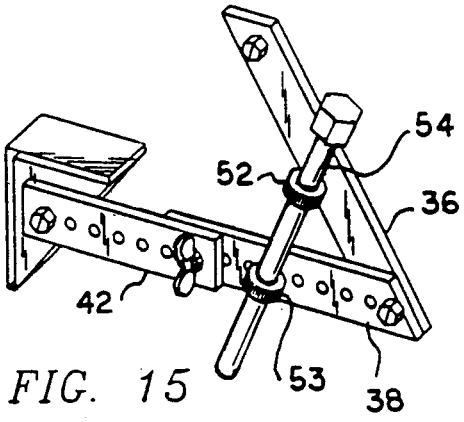
FIG. 15
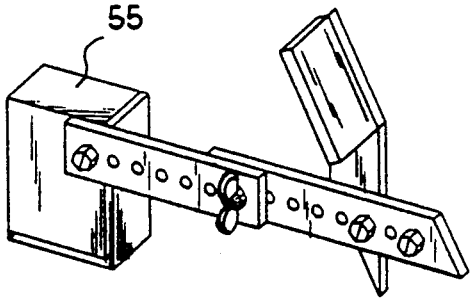
FIG. 16
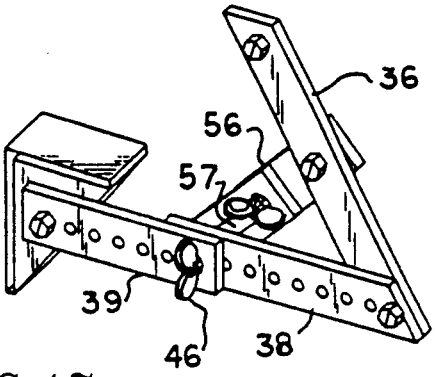
FIG. 17
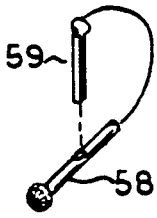
FIG. 18

LADDER STABILIZER APPARATUS

BACKGROUND OF THE INVENTION

1. Field of the Invention

The field of invention relates to ladder apparatus, and more particularly pertains to a new and improved ladder stabilizer apparatus wherein the same is arranged to position and secure a ladder in a non-sliding relationship relative to a dwelling during use.

2. Description of the Prior Art

Ladder apparatus of various types have been utilized in the prior art to secure and position a ladder relative to surface to be ascended, wherein such structure of the prior art has typically been of a complex and cumbersome organization discouraging its use. Alternatively, the structure has included shortcomings relative to the use and application of the ladder in accommodating various support surfaces. Such an apparatus is exemplified in U.S. Pat. No. 4,502,566 wherein a "U" shaped bar is mounted to a ladder and the "U" shaped bar includes projecting legs positionable against a support surface of the associated dwelling.

U.S. Pat. No. 4,723,632 to Gedgoudas, et al. provides for a roof support attachment for ladders, wherein a triangulated support includes an interconnecting tube member for positioning upon a support surface of the roof for providing a mounting structure for supporting the ladder during use.

As such, it may be appreciated that there continues to be a need for a new and improved ladder stabilizer apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of ladder apparatus now present in the prior art, the present invention provides a ladder stabilizer apparatus wherein the same is arranged to provide for the adjusting projection of arms relative to a ladder structure in its mounting relative to a dwelling during use of a ladder. As such, the general purpose of the present invention, which will be described subsequently in greater detail, is to provide a new and improved ladder stabilizer apparatus which as all the advantages of the prior art ladder apparatus and none of the disadvantages.

To attain this, the present invention provides an apparatus for securing and stabilizing a ladder and extension ladder structure relative to a dwelling, wherein the apparatus initially includes a plurality of arcuate arms mounted adjustable relative to tracks, wherein each track is secured to opposed ladder legs of an associated ladder structure. The arms each include anchor blocks, and the arms forward distal ends are mounted within cavities of each respective anchor block for positioning each anchor block upon a roof top surface. A further aspect of the invention includes organization for positioning and mounting the anchor structure relative to a bottom surface of a roof or to a vertical wall surface to include legs mounted adjustable relative to each ladder leg, wherein each of the legs are formed in an extensible configuration to include anchor structure mounted to each forward distal end of each of the legs.

My invention resides not in an one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder stabilizer apparatus which has all the advantages of the prior art ladder apparatus and none of the disadvantages.

It is another object of the present invention to provide a new and improved ladder stabilizer apparatus which may be easily and efficiently manufactured and marketed.

It is a further object of the present invention to provide a new and improved ladder stabilizer apparatus which is of a durable and reliable construction.

An even further object of the present invention is to provide a new and improved ladder stabilizer apparatus which is susceptible of a low cost of manufacture with regard to both materials and labor, and which accordingly is then susceptible of low prices of sale to the consuming public, thereby making such ladder stabilizer apparatus economically available to the buying public.

Still yet another object of the present invention is to provide a new and improved ladder stabilizer apparatus which provides in the apparatuses and method of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is an isometric illustration of the modified aspect of the invention as set forth in FIG. 10.

FIG. 12 is an isometric illustration of the mirror image anchor arm structure utilized by the invention.

FIG. 13 is an orthographic side view of an "L" shaped anchor foot utilized by the invention, as set forth in FIG. 10.

FIG. 14 is an orthographic side view of the arm structure, as illustrated in FIG. 12.

FIG. 15 is an isometric illustration of a modified adjustment structure utilized by the invention.

FIG. 16 is an isometric illustration of a modified anchor block and mounting bracket utilized by the invention.

FIG. 17 is an isometric illustration of a further modified adjusting structure utilized by the invention.

FIG. 18 is an isometric illustration of a lock pin structure utilized in lieu of a fastener structure employed by the invention.

DESCRIPTION OF THE PREFERRED EMBODIMENT

Figure 1:
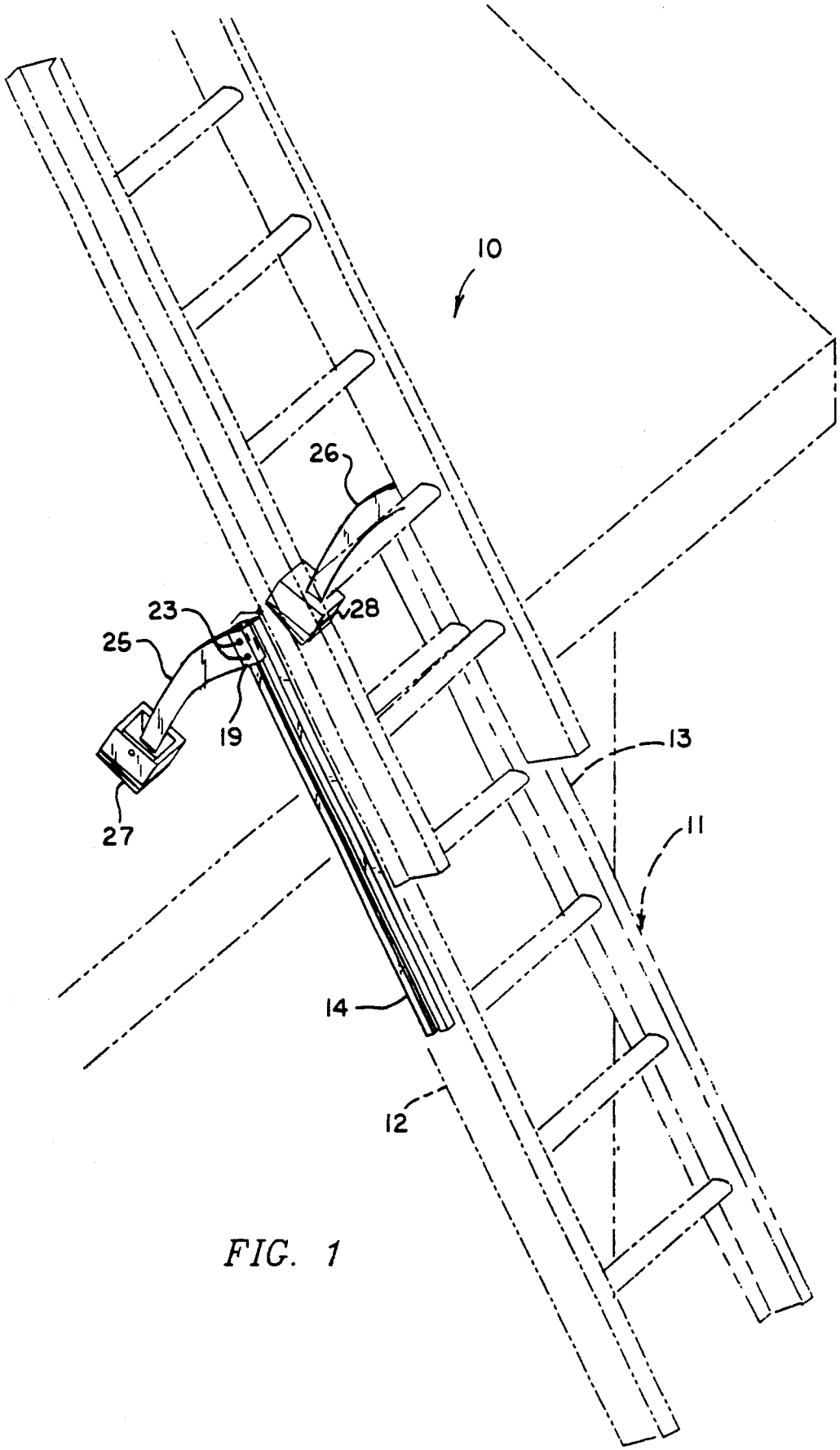
FIG. 1 is an isometric illustration of the instant invention.
Figure 4:
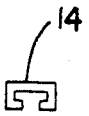
FIG. 4 is an orthographic top view of FIG. 3.
Figure 3:
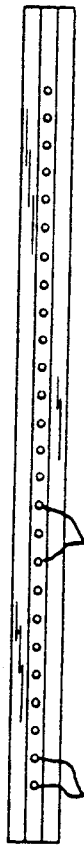
FIG. 3 is an orthographic view, taken in elevation, of a track structure utilized by the invention.
Figure 2:
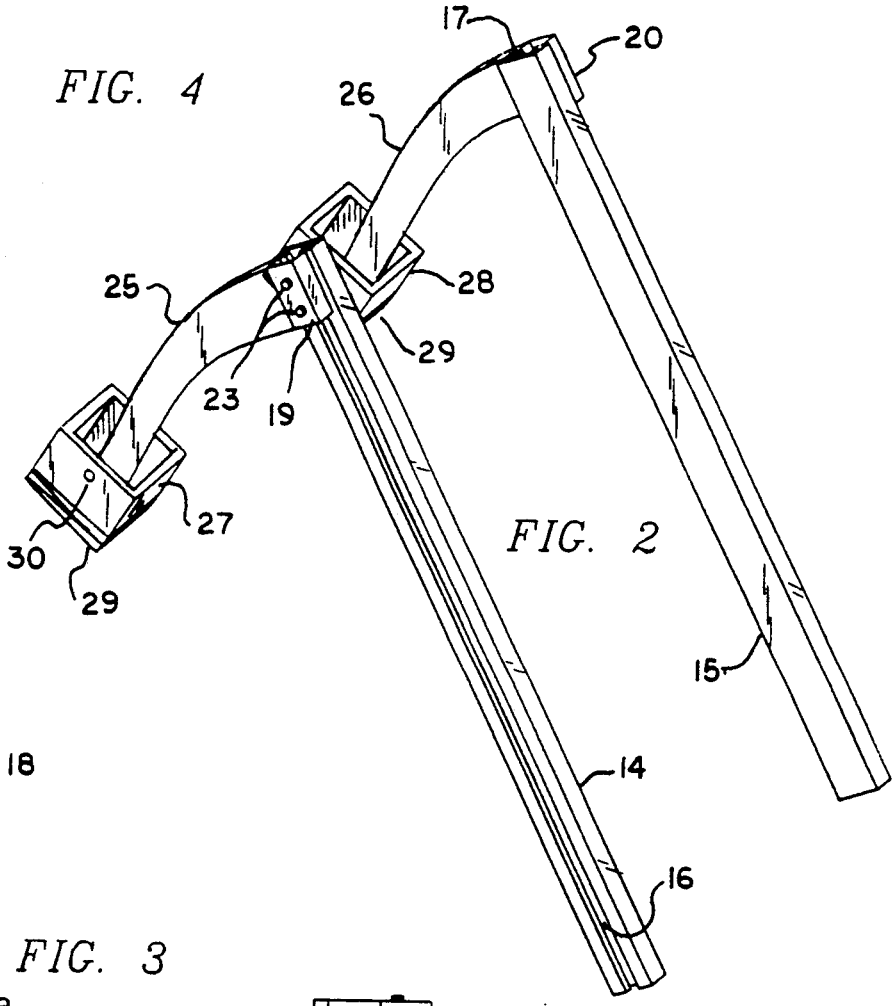
FIG. 2 is an isometric illustration of the invention removed from the associated ladder structure.
Figure 9:
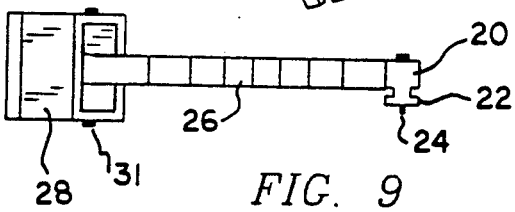
FIG. 9 is an orthographic side view of a mirror image anchor and arm structure utilized by the invention.
Figure 5:
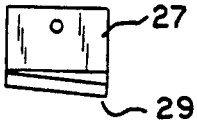
FIG. 5 is an orthographic side view of an anchor foot utilized by the invention.
Figure 7:
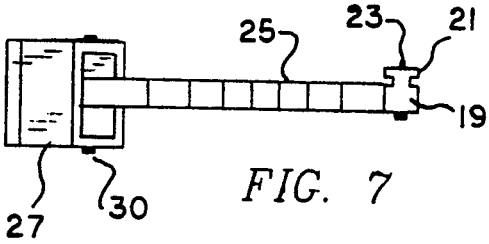
FIG. 7 is an orthographic top view of an arcuate arm and anchor member utilized by the invention.

With reference now to the drawings, and in particular to FIGS. 1 to 18 thereof, a new and improved ladder stabilizer apparatus embodying the principles and concepts of the present invention and generally designated by the reference numerals 10 and 10*a* will be described.

More specifically, the ladder stabilizer apparatus 10 of the instant invention essentially comprises a ladder member 11, including a respective first and second ladder leg 12 and 13 arranged in a parallel coextensive relationship relative to one another, with a first guide track 14 and a second guide track 15 mounted respectively to the first and second ladder legs 12 and 13, whereas the first and second guide tracks 14 and 15 are mounted in a parallel coextensive relationship. The first guide track includes a first "T" shaped groove 16, wherein the second guide track 15 includes a second "T" shaped groove 17. Each of the "T" shaped grooves 16 and 17 include an aligned row of groove bores 18 formed within a floor of each track for cooperation with first and second groove slide blocks 19 and 20 received within the respective first and second "T" shaped grooves 16 and 17. A first "T" shaped groove slide block extension 21 and a second "T" shaped slide block extension 22 are received within a respective "T" shaped groove 16 and 17 in a complementary sliding relationship. A first lock pin 23 orthogonally directed through the slide block 19 and the associated extension 21 is slidably directed therethrough and thereafter slidable received within one of the aforenoted groove bores 18 in the first "T" shaped groove 16, wherein similarly, a second lock pin 24 orthogonally directed through the second slide block 20 and the associated second slide block extension 22 slidably directed therethrough is thereafter selectively received within a bore 18 of the second "T" shaped groove 17. As illustrated, a plurality of such pins may be utilized for safety purposes. The groove bores 18 may also be threaded and thereafter threadedly directed in cooperation with an externally threaded lock pin 23 and 24 as required.

Figure 6:
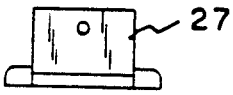
FIG. 6 is an orthographic side view of a modified anchor foot utilized by the invention.
Figure 8:
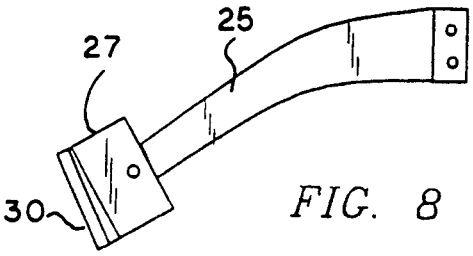
FIG. 8 is an orthographic side view of the structure as set forth in FIG. 7.

A first arcuate arm 25 mounted to the first slide block 19 and a second arcuate arm 26 mounted to the second slide block 20 are arranged in a parallel coextensive relationship, each including a concave lower surface in confronting orientation relative to the respective first and second guide tracks 14 and 15. A first anchor block 27 pivotally mounted to a forward distal end of the first arcuate arm 25 and a second anchor block 28 mounted to a forward distal end of the second arcuate arm 26 receive the arcuate arms within respective cavities of each anchor block and are pivotally mounted by respective first and second block axle 30 and 31 directed through each anchor block and the associated cavities. Each anchor block is accordingly formed with a resilient block bottom surface 29 for engagement with the roof surface, in a manner as illustrated in FIG. 1. Further, as illustrated in FIG. 6, the anchor block may be formed with an enlarged resilient surface to enhance engagement with the associated roof, as required.

Figure 10:
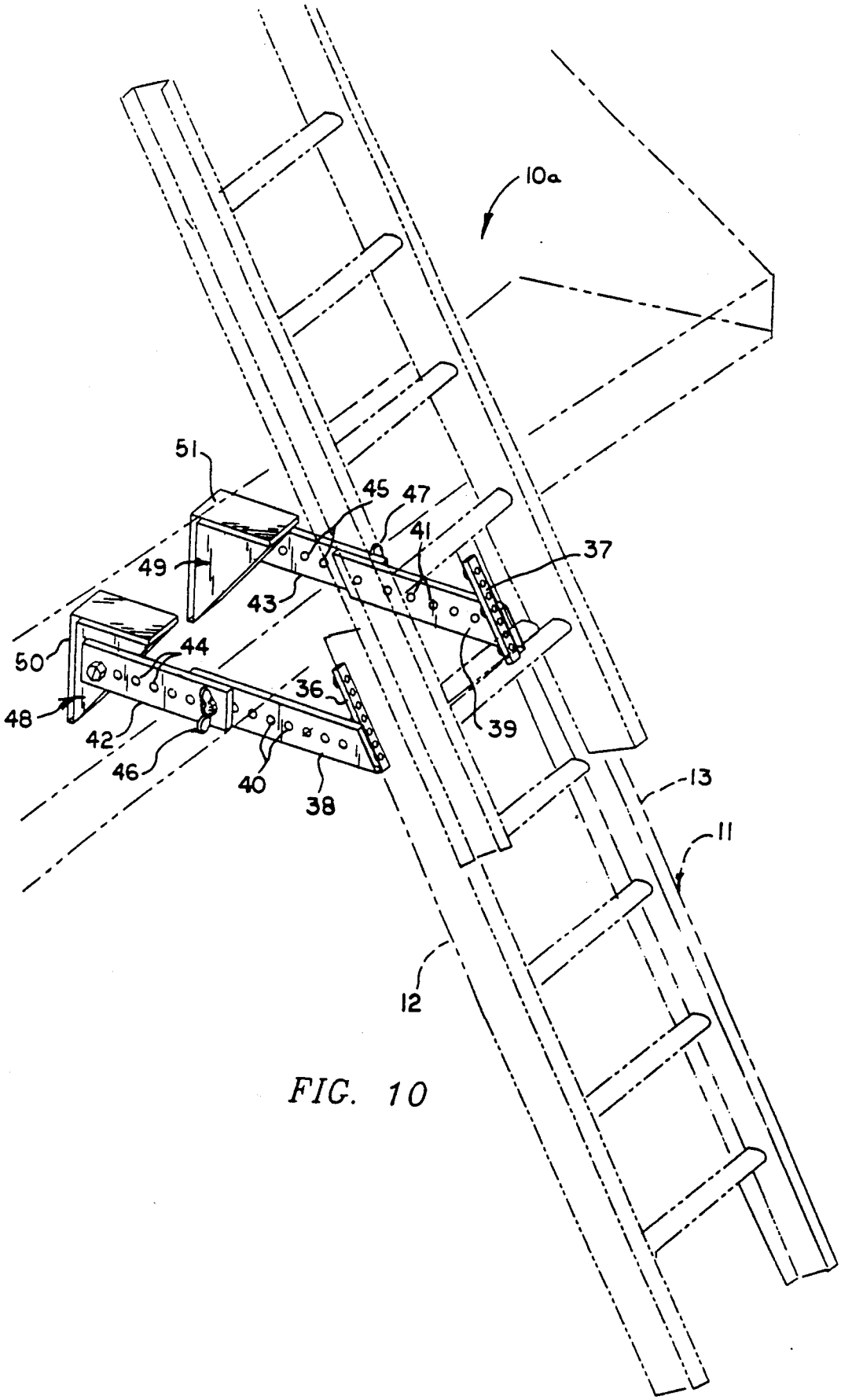
FIG. 10 is an isometric illustration of a modification of the invention.

The ladder stabilizer apparatus 10*a*, as illustrated in the FIGS. 10–18, is arranged to include the aforenoted ladder member 11, with a respective first and second mounting leg 36 and 37 fixedly mounted in a parallel coextensive relationship relative to one another to the respective first and second ladder legs 12 and 13. First extension leg 38 is mounted to the first mounting leg 36 extending forwardly thereof, with the second extension leg 39 mounted to the second mounting leg 37 extending forwardly thereof, as illustrated in FIGS. 10–12 for example. A row of first internally threaded apertures 40 are directed through the first internally apertures 40 are directed through the first extension leg 38, with a row of second internally threaded apertures 41 directed through the second extension leg 39. A first anchor leg 42 is mounted to the first extension leg, and a second anchor leg 43 mounted to the second extension leg, wherein a row of first anchor leg apertures 44 are directed through the first anchor leg, and a row of second anchor leg apertures 45 are directed through the second anchor leg. A first fastener 46 is thereafter directed through one of said anchor leg apertures 44 and one of said threaded apertures 40, wherein a second fastener 47 is directed through one of said second anchor leg apertures 45 and into engagement with one of said second threaded apertures 41 to thereby secure the legs relative to one another. If required, a plurality of such fasteners may be directed through a plurality of such apertures and associated threaded apertures in adjacency relative to one another. A first "L" shaped anchor foot 48 is mounted to a forward distal end of the first anchor leg, with a second "L" shaped anchor foot 49 mounted to a forward distal end of the second anchor leg 43. Each of the respective first and second anchor foot members 48 and 49 include respective first and second anchor foot "L" shaped polymeric friction surfaces 50 and 51 for engagement with a roof bottom surface or wall surface, in a manner as illustrated in FIG. 10.

FIG. 15 illustrates the first mounting leg 36, wherein each mounting leg 36 and 37 may be thusly constructed to include an upper internally threaded cylindrical member pivotally mounted to the first mounting leg aligned with a lower internally threaded cylindrical member 53 pivotally mounted to the first extension leg 38. The upper cylindrical member 52 is formed with a first threaded direction, with a lower threaded cylindrical member 53 formed with a second threaded direction, whereupon the externally threaded adjusting bolt 54 threaded to be complementarily received within the upper and lower cylindrical members 52 and 53 is directed rotatably therethrough, whereupon rotation in a first direction effects a spreading of the first mounting leg 36 relative to the first extension leg 38, wherein counter rotation effects a like contraction of the first mounting leg 36 relative to the first extension leg 38.

FIG. 16 illustrates the use of an angulated bracket member mounted to the first extension leg, as well as the use of an anchor block 55 for use upon planar roof top surfaces.

FIG. 17 illustrates the use of an adjustment plate 56 including a slot 57 longitudinally aligned within the plate 56 receiving the first "L" shaped anchor fastener 48 therethrough cooperative with a fastener to permit adjustment of the first mounting leg 36 relative to the first extension leg 38. The use of a first lock pin 58 in lieu of a fastener 46 in cooperation with a second lock pin 59 that is directed through the first lock pin may be utilized in lieu of fastener 46 in association with a threaded aperture 40.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United State is as follows:

1. A ladder stabilizer apparatus for use with a ladder member, the ladder member includes a first ladder leg parallel to and coextensive with a second ladder leg, said stabilizer apparatus comprises a first mounting leg fixedly mounted to the first ladder leg, and a second mounting leg mounted to the second ladder leg, and a first extension leg pivotally mounted relative to the first mounting leg, and a second extension leg pivotally mounted relative to the second mounting leg, the first extension leg including a row of first threaded apertures directed therethrough, and the second extension leg including a row of second threaded apertures directed therethrough, the first extension leg arranged parallel relative to the second extension leg, and a first and second anchor leg adjustably secured relative to the first and second extension leg, the first anchor leg including a row of first bore directed therethrough, and the second anchor leg including a row of second bores directed therethrough, and a first fastener directed through one of said first bores and one of said threaded apertures, and a second fastener directed through one of said second threaded apertures and one of said second bores, and a first "L" shaped anchor foot mounted to a forward distal end of the first anchor leg, and a second "L" shaped anchor foot mounted to a forward distal end of the second anchor leg, the first "L" shaped anchor foot including a first anchor foot "L" shaped polymeric friction surface coextensive to an exterior surface of the first anchor foot, and a second anchor foot "L" shaped polymeric friction surface mounted to an coextensive with an exterior surface of the second "L" shaped anchor foot, and first adjustment means mounted to the first mounting leg and the first extension leg to effect adjustment of the first mounting leg relative to the first extension leg, and second adjustment means mounted to the second mounting leg and the second extension leg for adjustment of the second extension leg relative to the second mounting leg.

2. An apparatus as set forth in claim 1 wherein the first adjustment means includes an upper internally threaded cylindrical member mounted pivotally to the first mounting leg, and a second internally threaded cylindrical member pivotally mounted to the first extension leg, and an externally threaded adjusting bolt threadedly received within the first cylindrical member and the second cylindrical member, whereupon rotation of the adjusting bolt effects selective angular adjustment of the first mounting leg relative to the first extension leg.

3. An apparatus as set forth in claim 2 wherein the second adjustment means includes a further first cylindrical member pivotally mounted to the second mounting leg and a further second internally threaded cylindrical member pivotally mounted to the second extension leg, and a further adjusting bolt threadedly received within the further first cylindrical member and the further second cylindrical member to effect angular adjustment of the second mounting leg relative to the second extension leg.

* * * * *